US005232419A

United States Patent [19]

Kozak

[11] Patent Number: 5,232,419

[45] Date of Patent: Aug. 3, 1993

[54] WALKING MACHINE

[76] Inventor: Larry S. Kozak, Rte. 8 Box 8256, Manchester, Tenn. 37355

[21] Appl. No.: 983,812

[22] Filed: Dec. 1, 1992

[51] Int. Cl.[5] ..... A63B 22/04; A63B 23/10

[52] U.S. Cl. ..... 482/52; 482/80

[58] Field of Search ..... 482/30, 31, 79, 80, 482/51, 52, 53, 127, 133, 121, 122, 123, 129, 130

[56] References Cited

U.S. PATENT DOCUMENTS

| | | | |
|---|---|---|---|
| 3,804,405 | 4/1974 | Giddings | 482/31 |
| 3,814,420 | 6/1974 | Encke | 482/79 |
| 4,422,635 | 12/1983 | Herod et al. | 482/80 |
| 5,069,445 | 12/1991 | Mai | 482/30 |

FOREIGN PATENT DOCUMENTS

| | | | |
|---|---|---|---|
| 1032140 | 6/1958 | Fed. Rep. of Germany | 482/31 |

*Primary Examiner*—Stephen R. Crow
*Attorney, Agent, or Firm*—Abe Hatcher

[57] ABSTRACT

A walking machine made up of two walking members mounted on a frame which includes two sides and at least one cross piece from which the walking members extend upward and outward so that they will go up and down according to which foot of an individual is raised and which pressed down in a stand-still walk. The walking members are made of spring steel and the frame preferably of structural angles.

5 Claims, 1 Drawing Sheet

WALKING MACHINE

BACKGROUND OF THE INVENTION

1. Field of the Invention

This invention relates to exercise machines. More particularly, it relates to an improved walking machine.

2. Description of the Prior Art

Current walking machines use two mounted pronglike members slightly bent so that a person can step on them and then begin walking because of cylinders underneath which enable the pronglike members to give when the feet are raised up and down on them in a walking manner even the prongs themselves are stationary. Considerable support mechanism and parts are required to withstand hard use.

SUMMARY OF THE INVENTION

After extended investigation I have found that by using spring steel, for example, the type that is used in automobile, wagon and the like leaf springs, for the foot pedals or walking members of a stationary walker, I can omit the complicated pistons and cylinders heretofore required of such a walker. The only other part required of my walking machine is a support frame, which is made up of two lengthwise or side members and at least one cross member of a rectangle, two cross members being preferred for surdiness and stability when a walker steps up on the walking members of the walking machine of the invention and begins to smoothly lift one foot at a time walking in place. The walking members of spring steel are parallel and expend upward and outward, one from close to one side of an end member and the other from close to the other side of the end member, so as to be about as far apart as a walker's feet. It is preferred that each pedal member or walking member extend upward, preferably bent just a little to form a slight valley in the middle, 20 to 40 degrees or so before levelling out slightly for a foot portion, though still extending upward at about the same angle as at the start.

Each pedal member or walking member begins approximately at a back edge of a rearward horizontal portion of a first structural angle at the beginning end of the walking member or pedal member and continues affixed thereto by welding or otherwise to where it goes through a slit-like opening in a downward extending portion of the first cross-member structural angle (heretofore referred to as a first structural angle). I also prefer to use a second cross-member structural angle at the other end or ending end of the frame rectangular or rectangular frame. For added strength I prefer to also use an angular support member or brace, for each pedal member or walking member, which goes from a point of attachment at a bottom or lower edge of a downward extending portion of the first cross-member structural angle to a point of attachment at a starting edge of a horizontal portion of the first cross-member structural angle and a rear or starting edge of a pedal member or walking member, each pedal member or walking member being joined, for example, by welding, to the top side of the first cross-member structural angle from which each pedal member or walking member extends. Parallel angle iron or structural angle side members of the rectangular frame, which is preferably completely rectangular but may have only one cross-member structural angle, if it is desired to have a lighter structure, are affixed, for example, by welding, preferably to the end edge of the first or second cross-piece structural member or both.

BRIEF DESCRIPTION OF THE DRAWING

For a better understanding of my invention reference will now be made to the drawing which forms a part hereof.

DETAILED DESCRIPTION

Figure 1:
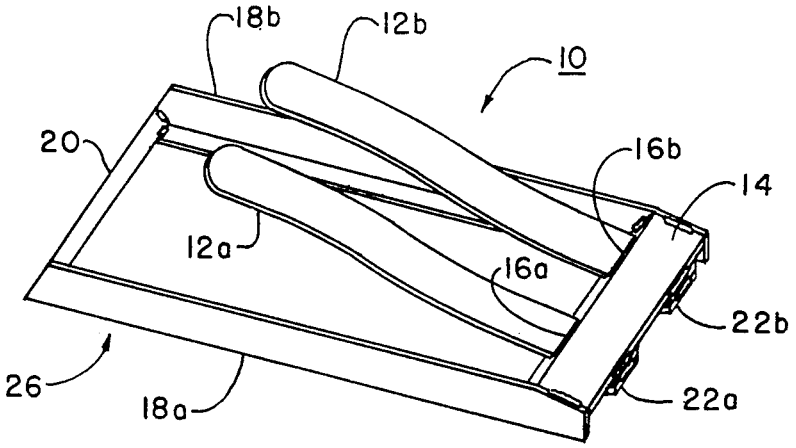
FIG. 1 is a top view of the walking machine of the invention.
Figure 2:
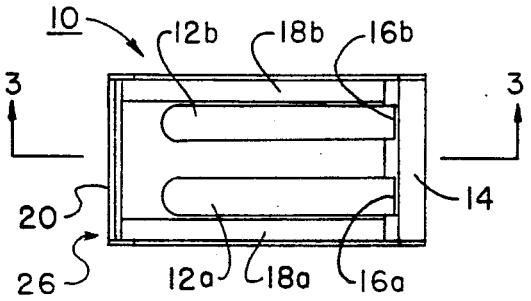
FIG. 2 is a plane view of the walking machine of the invention.
Figure 3:
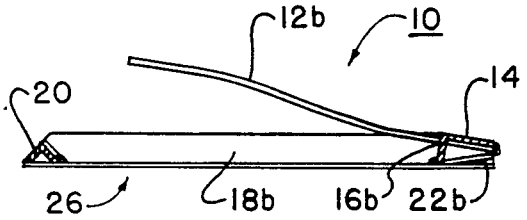
FIG. 3 is a side (longitudinal) view of the walking machine of the invention taken at 3—3 of FIG. 2, partly cut away.
Figure 4:
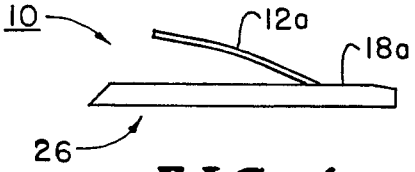
FIG. 4 is a side elevation view of the walking machine of the invention.
Figure 5:
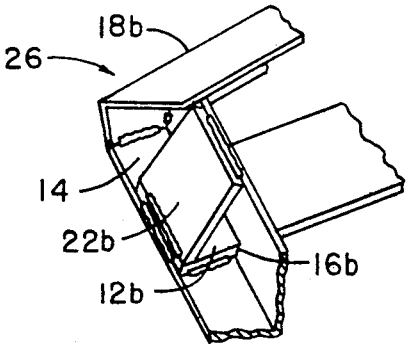
FIG. 5 is an underside perspective view detailing an angular support member or brace for a pedal member or walking member of the walking machine of the invention.
Figure 6:
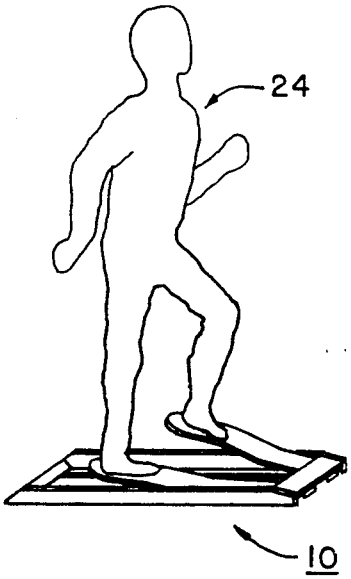
FIG. 6 is a perspective view showing an individual walking on the walking members of the walking machine of the invention by pushing down on the right foot as he or she lifts the left.

The walking machine of the invention 10 is made up basically of a rectangular frame 26 and two pedal members or walking members 12*a* and 12*b* shaped such that an individual 24 may walk thereon in a stationary manner by raising a left foot to let one of the walking members spring up as he or she puts his or her weight on the right foot to bend it down, ging the alternate upward and downward movement for each walking member and foot to simulate actual walking as the walking members go up and down as the feet go up and down. (See FIG. 6). Frame 26 includes a first cross-member structural angle 14 from which spring steel walking members 12*a* and 12*b* extend, a second end or cross-member structural angle 20, side or longitudinal members 18*a* and 18*b*, angular support members or braces 22*a* and 22*b*, the latter shown in more detail in FIGS. 3 and 5 as going between one side of the angle to the other of cross-member structural angle 14, and slit-like openings 16*a* and 16*b* through which walking members 12*a* and 12*b* come from their point of attachment to first end or cross-member structural angle 14 as shown in FIG. 5.

For all of the members of my walking machine except the spring steel walking members I use steel iron, heavy plastic or any other commonly used structural material.

While the invention has been described in terms of preferred embodiments, the claims appended hereto are intended to encompass all embodiments which fall within the spirit of the invention.

Having thus described my invention and certain preferred embodiments thereof, I claim:

1. A walking machine comprising two parallel walking members of spring steel mounted on a frame, said parallel walking members being angled upward from a cross member of said frame and being sufficiently wide for an individual's feet to step up on and simulate walking.

2. The walking machine of claim 1 wherein said parallel walking members are levelled slightly at an upper end away from said cross member for placing said individual's feet thereon.

3. The walking machine of claim 1 wherein said frame comprises a rectangle.

4. The walking machine of claim 3 wherein two side members and two cross members comprise structural angles joined together to form said rectangle.

5. The walking machine of claim 3 wherein said rectangle comprises two parallel side member structural angles joined at an interval by first and second parallel cross-member structural angles, said parallel walking members being attached to a horizontal portion of said first cross-member structural angle at one end of said rectangle and passing through slit-like openings in an upwardly directed portion of said first cross-member structural angle, and an angular support member for each walking member which goes from point of attachment at a lower edge of a downward extending portion of said first cross-member structural angle to a point of attachment at a starting edge of a horizontal portion of said first cross-member structural angle and a starting edge of each said walking member.

* * * * *